United States Patent [19]

Pearson et al.

[11] Patent Number: 5,070,555

[45] Date of Patent: Dec. 10, 1991

[54] OSCILLATABLE HOSPITAL BED FOOTBOARD ASSEMBLY

[76] Inventors: Wendy P. Pearson, 117 Central St., Apt. D2, Acton, Mass. 01720; John C. Schmidt, 32102 Sailview La., Westlake Village, Calif. 91361

[21] Appl. No.: 620,639

[22] Filed: Dec. 3, 1990

[51] Int. Cl.[5] ..... A61G 7/06

[52] U.S. Cl. ..... 5/80; 5/444; 128/25 B

[58] Field of Search ..... 5/80, 443, 444; 128/25 B, 80 E

[56] References Cited

U.S. PATENT DOCUMENTS

| | | | |
|---|---|---|---|
| 1,007,733 | 7/1913 | Hassel | 5/444 |
| 1,694,095 | 12/1928 | DuMoulin | 5/444 |
| 2,952,855 | 9/1960 | Zuti | 5/444 |
| 3,195,151 | 7/1965 | Boyer | 5/80 |
| 3,318,304 | 5/1967 | Gurewich | 128/25 B |
| 3,548,811 | 12/1970 | Wilson | 128/25 B |
| 3,625,203 | 12/1971 | Wadelton | 128/25 B |
| 3,695,255 | 10/1972 | Rodgers et al. | 128/25 B |
| 3,866,251 | 2/1975 | Pounds | 5/444 |
| 4,635,931 | 1/1987 | Brannston | 128/25 B X |
| 4,705,028 | 11/1987 | Melby | 128/25 B |
| 4,936,300 | 1/1990 | Funatogawa | 128/25 B |

*Primary Examiner*—Michael F. Trettel
*Attorney, Agent, or Firm*—George W. Dishong

[57] ABSTRACT

A method for regularly and controllably flexing and extending the feet and the legs of a patient who is unable to move their legs and/or feet due to some physical or mental disorder. The oscillating footboard assembly is adjustable and adaptable to the users size. The oscillating footboard assembly is designed to regularly flex and extend (by a controllable amount of excursion and at a controllable frequency) the feet and the legs of a patient who is unable to move their legs and feet due to a physical ailment such as a stroke, coma, or paralysis. If the feet and legs are not regularly flexed and extended, they "freeze" in the extended position and it is extremely difficult and in some instances, impossible to resolve this problem. The frequency and the excursion of the oscillation may be adjustable on the assembly depending upon the needs of the patient. The assembly is easily and comfortably attachable to the patient through the use of booties or other means such as foot straps. The booties or foot straps or other similar and effective devices may be attached to the footboard assembly, and particularly the footboard member of the assembly, using VELCRO TM type of fastening material or by any other appropriate fastening means.

7 Claims, 6 Drawing Sheets

OSCILLATABLE HOSPITAL BED FOOTBOARD ASSEMBLY

BACKGROUND OF THE INVENTION

1. Field of the Invention

This invention most generally relates to a method and apparatus or assembly for regularly and controllably flexing and extending, by oscillating or by undulating, the feet and the legs of a patient who is unable to move their legs and/or feet due to some physical or mental disorder. The present invention is also directed to an oscillating or undulating footboard assembly which is adjustable and adaptable to the users size. More particularly, the oscillating footboard assembly is designed to regularly flex and extend, by a controllable amount of excursion, at settable periods of time and at controllable frequencies, the feet and the legs of a patient who is unable to move their legs and feet due to a physical ailment such as a stroke, coma, or paralysis.

2. Description of the Prior Art

Hospital workers, on a daily basis, see patients suffering from medical condition called "footdrop". This condition occurs when a patient is unable to move their legs and feet due to a stroke, coma, or paralysis. The foot goes into an extended, pointed position. Unless the muscles of the feet and legs are regularly flexed and extended by a physical therapist or nurse, they "freeze" in the extended position and is extremely difficult if not impossible to resolve this problem. Presently there is no device known to the applicants hereof which is similar to the assembly/device disclosed herein which even remotely addresses the prevention of "footdrop". In many hospitals and other facilities for the care of the infirmed, plain pieces of plywood, unfinished and with sharp square edges have been used because nothing more proper is available. The plywood is used by placing it between the footboard of the bed and the footend of the mattress. The idea of a footboard is to maintain the position of the feet up against the board to prevent extension of the feet as mentioned above. However, when an average-sized person is positioned properly in bed, their feet do not come close to resting on the board. Even if the feet of the patient are placed so that they rest against the footboard, the onset of pressure will result in the patient being moved toward the head-end of the bed and thus footdrop will nevertheless take place. Further, the use of such a primitive approach is the breakdown of skin of the feet of the patient due to the pressure of the foot against the hard surface of the plywood.

Presently there is on the market, leg braces called Podus Splints. They are very bulky, made of hard plastic, with numerous VELCRO TM brand of fastener straps to keep them on the patient. These splints cause patients to become hot and uncomfortable; and frequently cause deep grooves on the patients skin. Many patients refuse to wear these devices. The "footboards" presently used offer no means of movement for the foot and without regular motion, footdrop will occur.

After reviewing patents which were developed in a search, no structure or method for the continuous and controlled regular flexing of the feet and legs of bed-ridden patients similar to the present invention was found nor was one suggested. None of the prior art known to the inventors hereof satisfies the need for effectively passively exercising/flexing the feet and legs in an effective, simple and economically feasible way and thereby avoiding the so-called "freezing" phenomenon.

No one has considered the advantage of having a device such as has been disclosed herein, which can be easily mounted on the bed of a patient and easily and effectively attached to the patient for the purpose of flexing, by simply oscillating a footboard, the feet and/or legs of a patient who may be unable to or instructed not to move his or her legs.

The U.S. patents reviewed were: U.S. Pat. No. 3,021,837 to Newell; U.S. Pat. No. 3,866,251 to Pounds; U.S. Pat. No. 3,893,197 to Ricke; U.S. Pat. No. 4,104,751 to Churchman; U.S. Pat. No. 4,277,660 to Lemmer; U.S. Pat. No. 4,381,572 to Thumberger; and U.S. Pat. No. 4,867,140 to Hovis et al. In particular the Newell patent shows a footboard with pads and straps. The Pounds patent discloses an angular adjustment. The Ricke '197 patent discloses a telescopic adjustment and the Ricke et al '334 patent describes a footboard with vertical height adjustment. In the Churchman patent there is described a footboard with a frictional tongue to insert between mattresses. Lemmer and Thumberger teach adjustable footboards. Finally Hovis et al describes a passive motion device which is inflatable.

SUMMARY OF THE INVENTION

The present invention in it's most simple form or embodiment is directed to a method and an assembly for regularly and controllably flexing and extending the feet and the legs of a patient who is unable to move their legs and/or feet due to some physical or mental disorder and thereby substantially prevent or or at least delay the occurrence of so-called footdrop. The present invention is also directed to an oscillating footboard assembly which is adjustable and adaptable to the users size. The oscillating footboard assembly is designed to regularly flex and extend (by a controllable amount of excursion and at a controllable frequency) the feet and the legs of a patient who is unable to move their legs and feet due to a physical ailment such as a stroke, coma, or paralysis. If the feet and legs are not regularly flexed and extended, they "freeze" in the extended position and resolution of this problem is extremely difficult if not impossible. The frequency and the excursion of the oscillation may be adjustable on the device depending upon the needs of the patient. The assembly is easily and comfortably attachable to the patient through the use of booties or other means. The booties or foot straps or other similar and effective devices which may be attached to the footboard assembly, and particularly the footboard member of the assembly, using VELCRO TM type of fastening material or by any other appropriate fastening means.

A primary object of the invention is to provide, in combination with a bed having at least a mattress and a foot-end frame component, an oscillatable footboard assembly comprising: a frame member adapted to be attachable to at least one side of the bed (preferably attachable to both sides of the bed); means for removably and nondamagingly attaching the frame member to the bed in a position appropriate for a patient positioned thereon which may include at least one attaching bar, the bar further attaching the frame assembly to the foot-end frame component of the bed. Further, there is a footboard member which may be rotatably and oscillatably attached to the frame member. The footboard member has a surface upon which feet of the patient lying (or sitting) on the bed may be releasably attachable. There is also provided a means for oscillating either the footboard member or the surface upon which the feet of the patient rests about an axis substantially perpendicular to a long side of the bed and substantially parallel to an upward-facing mattress surface; a means for activating and deactivating oscillation excursion of the footboard member or the surface of the footboard member; and means for securely but releasably attaching the feet of the patient to the footboard member in a position so that an ankle pivot of the patient is about in-line with the oscillation axis.

A more particular object of the present invention is to provide the oscillatable footboard assembly with a means for controlling the excursion amplitude of the oscillation and wherein the means for activating and deactivating further comprises a settable timer. The timer activates and deactivates the means for oscillating at present times.

An even more particular object of the present invention is to provide the oscillatable footboard assembly with a means for controlling a frequency of the oscillation excursion.

A still more particular object of the present invention is to provide the oscillatable footboard assembly with a means for providing to-and-fro linear motion of the footboard member or the surface of the footboard member in a direction substantially parallel to the long side of the bed and substantially parallel to the upward-facing mattress surface by a distance not greater than the maximum linear distance of the foot of the patient when the foot is moved from a fully extended position to a fully flexed position. There may be also provided a means for activating and deactivating the means for providing to-and-fro linear motion of the footboard member and wherein the means for activating and deactivating the means for linearly moving to-and-fro, the footboard member, further comprises a settable linear motion timer. The linear motion timer thereby activates and deactivates the means for linearly moving the footboard member at preset times. Additionally there may be provided a means for controlling a distance amplitude and a rate of linear motion of the footboard member or the surface of the footboard member. The oscillatable footboard assembly may also be provided with a means for providing to-and-fro linear motion of the footboard member wherein the feet of the patient positioned on the bed are moved alternately in a manner which simulates walking.

These and further objects of the present invention will become apparent to those skilled in the art to which this invention pertains and after a study of the present disclosure of the invention.

DESCRIPTION OF THE PREFERRED EMBODIMENTS

Figure 1:
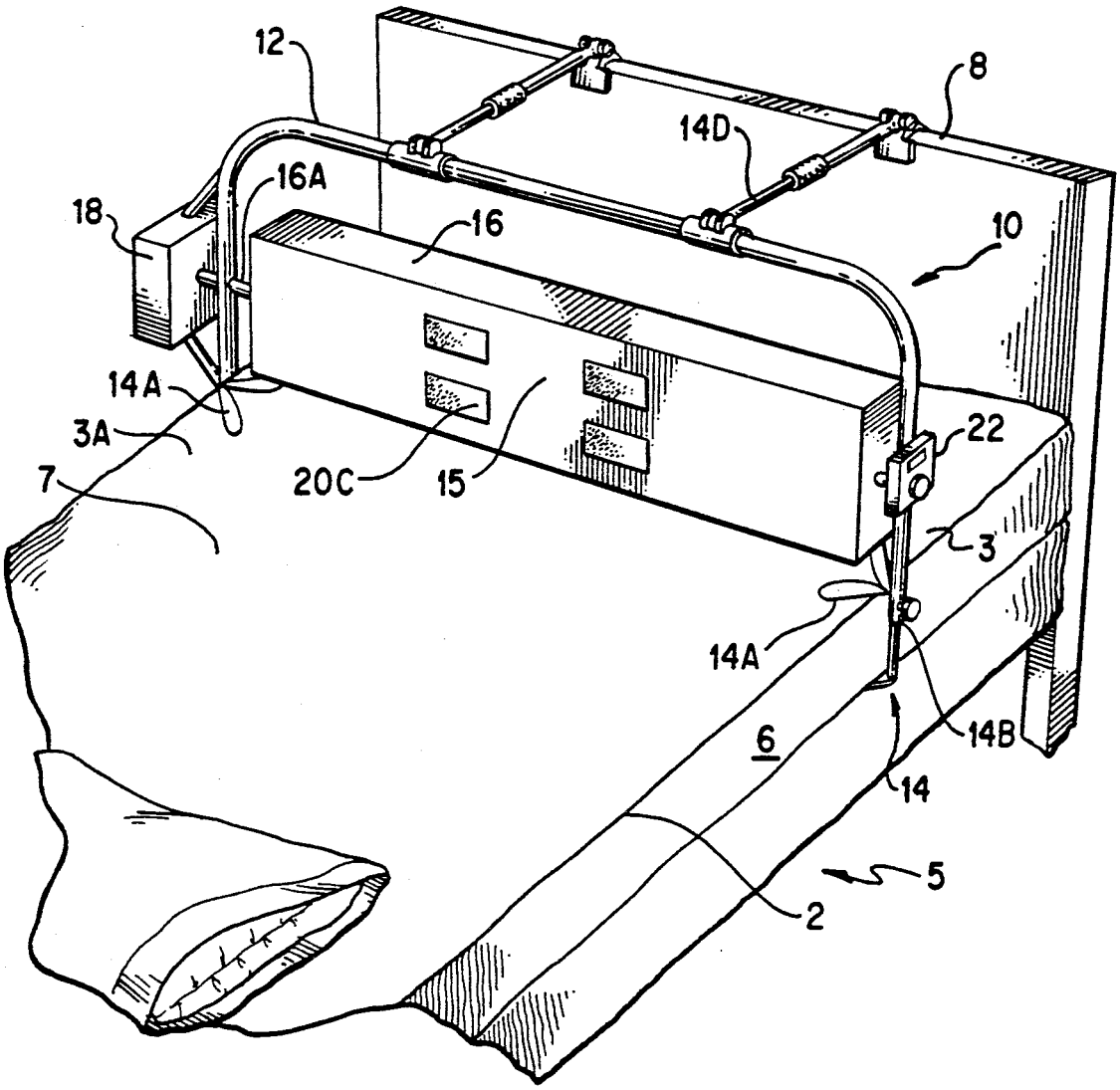
FIG. 1 is a perspective illustration of the oscillatable footboard assembly attached to a hospital bed and showing schematically the controls and the various means for driving or powering the footboard.
Figure 2:
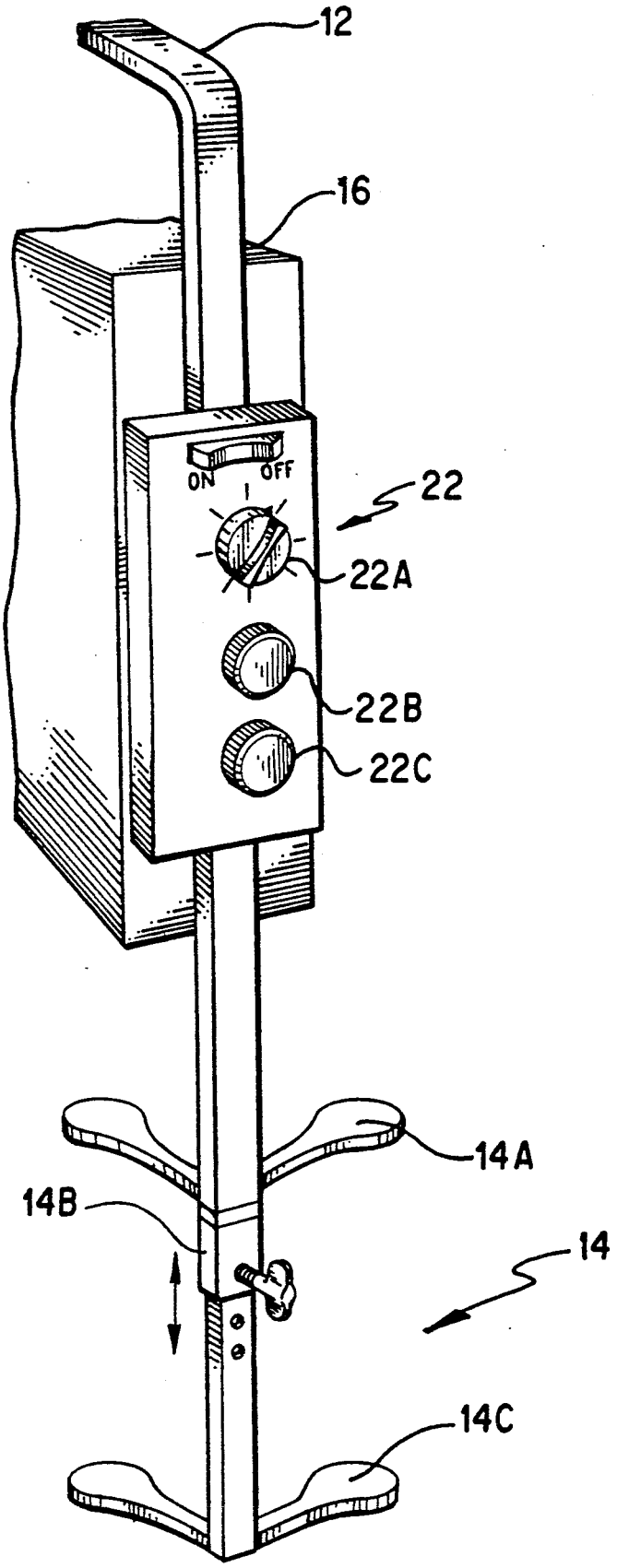
FIG. 2. is a partial perspective right side view of the oscillatable footboard assembly showing schematically a portion of the means for mounting the assembly to a mattress of a bed and a schematic representation of the means for controlling the regimen of motion of the footboard member of the assembly.
Figure 3:
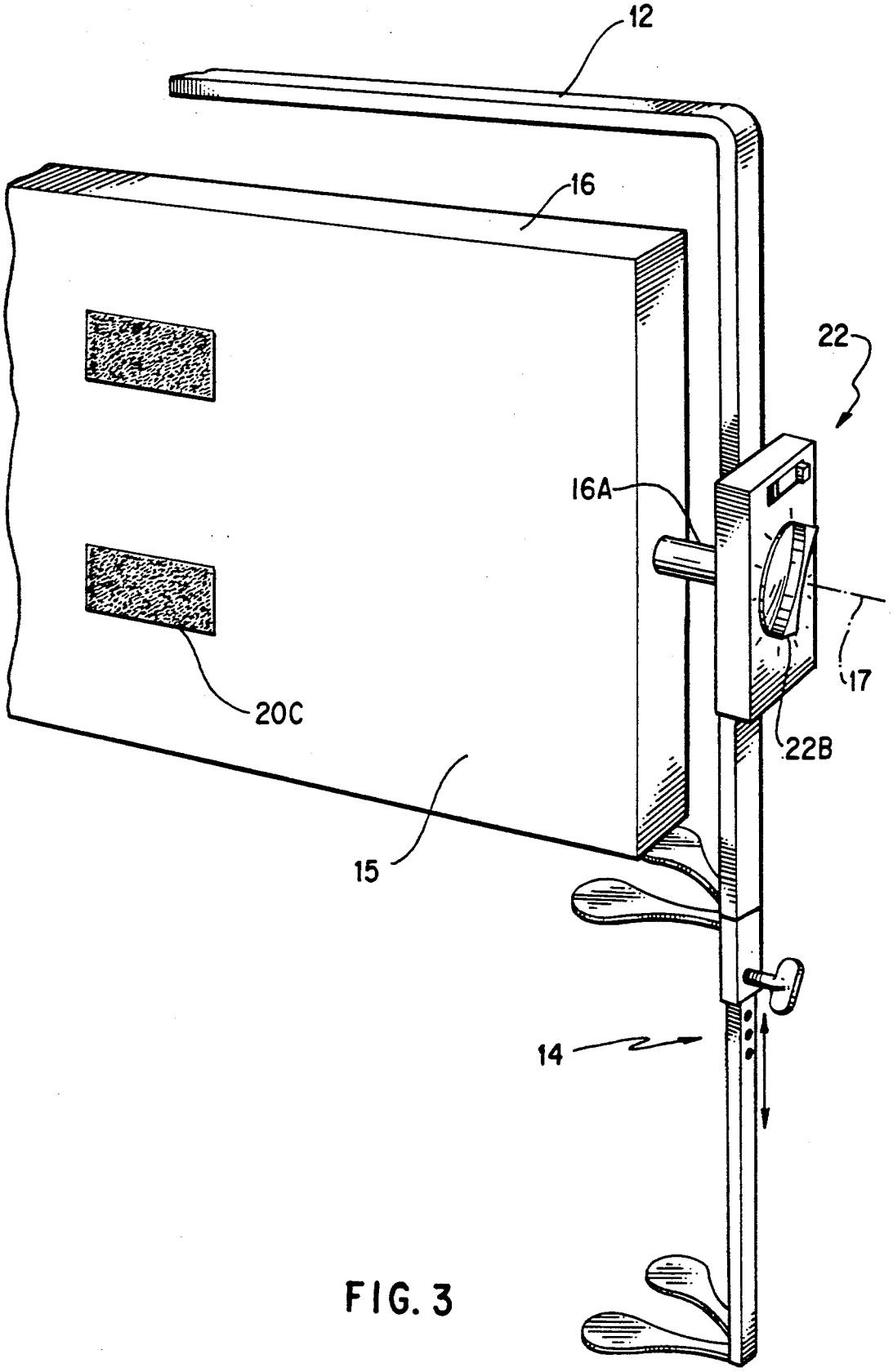
FIG. 3. is a partial perspective from the front and right side view of the oscillatable footboard assembly illustrating schematically the various members of the assembly along with the VELCRO TM brand of fastener attached to the surface of the footboard member.

The following is a description of the preferred embodiment of the invention. It is clear that there may be variations in the size and the shape of the assembly. It is within the scope of the invention to include means for adjusting the various dimensions of the assembly so that it may be used with beds of different widths, different footboard components and for furniture pieces other than beds on which or in which a disabled patient may be positioned. The primary feature and function of the invention is to provide controlled motion, using mechanical, electrical, pneumatic, hydraulic or other driving systems alone or in combination, to the feet and/or the legs of the patient. The feet and/or the legs are being moved in a manner so as to reduce the tendency for the patient to experience so-called footdrop and the resulting freezing of the legs feet in the footdrop position all of which is primarily due to the lack of motion of the feet and legs over a period of time. The range of motion, when the motion begins and ends and the frequency of the oscillatory movement may all be automatically controlled by presets which are based upon a prescribed regimen of motion for the particular patient. It is suprising that the procedures and the assembly to carry out the procedures have not been used to prevent the several maladies experienced by immobile patients and which result from the lack of motion of the feet and legs for extended periods of time.

In order to describe the invention most clearly and simply, the assembly 10 will be described in use in combination with a hospital bed 5. The device could very easily be configured by one of ordinary skill to work in combination with chairs on which a patient may be placed. The feet and the legs of the patient could then be regularly and systematically flexed providing the motion needed by the patient. It is also within the scope of the present invention to include apparatus to cause the surface 15 of footboard member 16 to exhibit an oscillatory and/or an undulatory motion provided possibly by a wave motion of the surface 15. Such undulation may be achieved using controlled, pulsating air pressure or other fluid pressure created inside of the footboard 16 which reacts with surface 15 which surface 15 may be made of flexible membrane. Such motion would be translatable to the feet and legs of a patient attached to the assembly. It is within the skill of ordinary practitioners to provide the means to create a variety of such motions using the advantages of hydraulics, pneumatics, electronics, mechanics, fluidics and the like. What is described herein using the drawing figures is a mechanical system which provides for the basic oscillatory motion along with a schematic illustration for the incorporation of linear to-and-fro motion.

Reference is now made to FIGS. 1–6 all of which collectively depict an embodiment of the assembly 10 of the invention.

The invention is comprised of the following fundamental components: a) a frame member 12 (obviously the frame member could take on many configurations appropriate to the bed on which it is used and based upon the size and shape of the footboard member 16 upon which the feet of the patient are attached); b) a means 14 for securely attaching the frame member 12 to bed 5 in a position which is appropriate to the patient; c) a footboard member 16, or a surface 15 of the footboard member 16, which is able to oscillate and/or move linearly to-and-fro, when driven in a manner which will achieve the flexing and/or the leg bending of the patient to which it is releasably attached; d) a means 18 for causing the footboard member 12, or surface 15 of the footboard member 16, to oscillate about shaft or axis rod 16A which shaft 16A defines an axis 17 which axis 17 is across the bed 5 and about perpendicular to the long side 2 of bed 5; e) means 22 for activating and deactivating the oscillation means 18 which means for activating may include a means 22A for controlling the amplitude or the excursion of the oscillation and may include a means 22C for controlling the frequency of the oscillation and means 22B to control the time when oscillations begin and end; and f) a means 20 for securely but releasably attaching the feet of the patient to the footboard member 16, and particularly to surface 15 in a position so that the feet are flexed properly about a pivot of the ankle of the patient.

Figure 4:
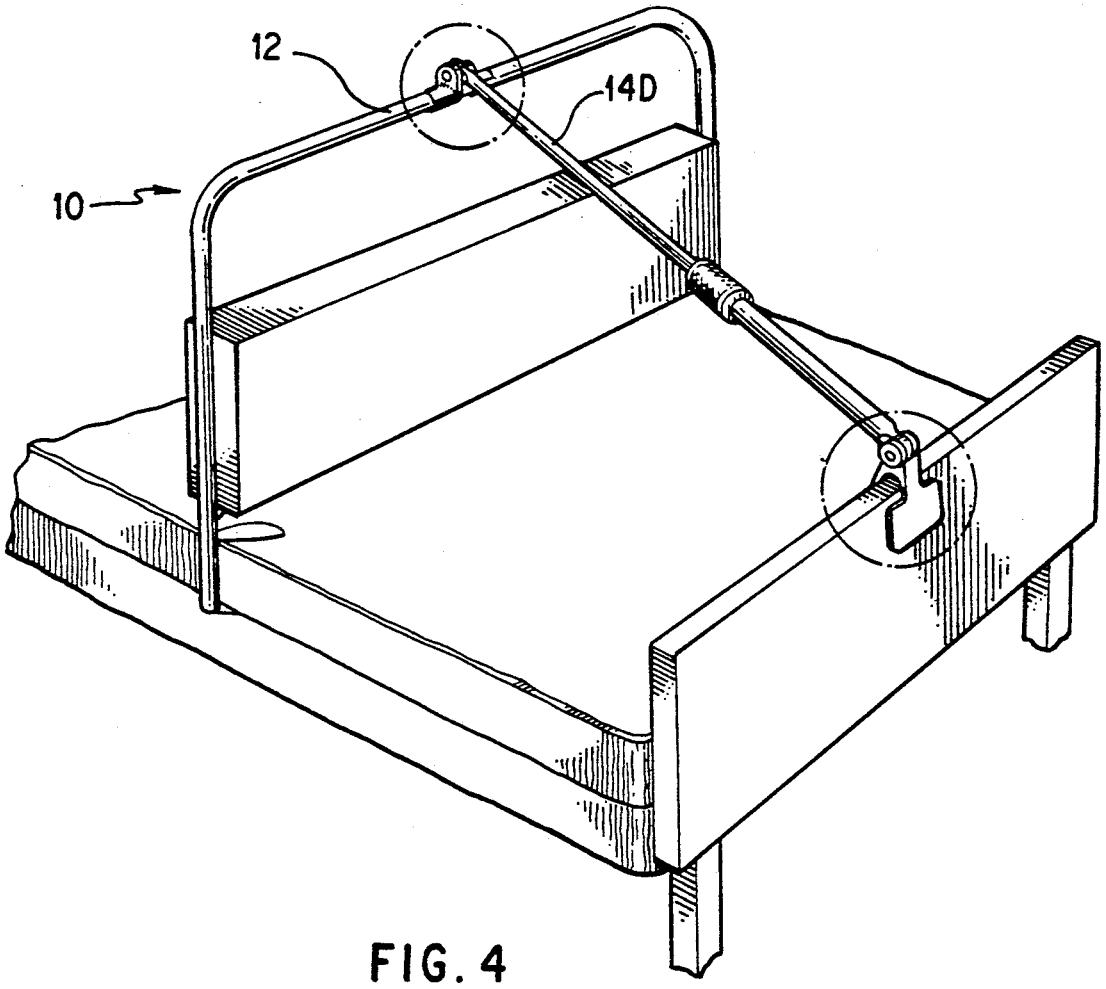
FIG. 4. is a side view perspective sketch illustrating the adjustable length rod which is used to attach the assembly to the bed including a sketch of the joints at the rod ends.
Figure 4A:
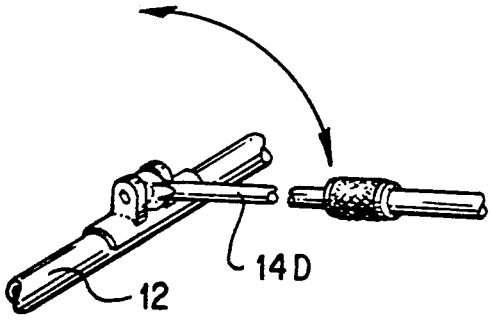
FIG. 4A is a sketch of the pivotable joint at the rod end attached to the frame member of the assembly.
Figure 4B:
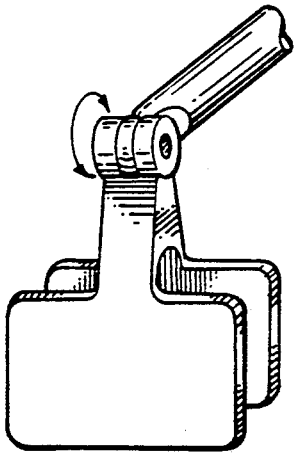
FIG. 4B is a sketch of the pivotable joint and the "clamp" at the rod end which attaches to the foot-end of the bed.
Figure 5B:
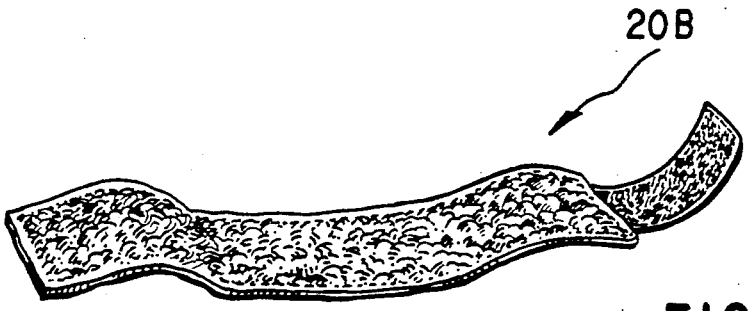
FIG. 5B is a sketch illustrating the simple strap used for attachment of a foot of a patient to the surface of the footboard member.
Figure 5A:
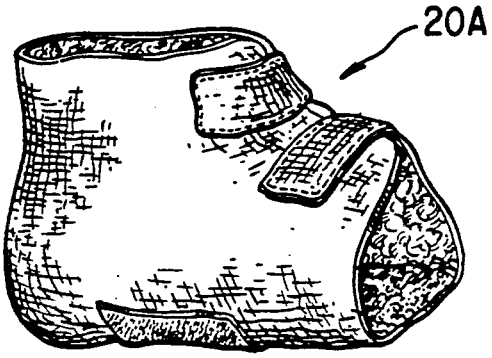
FIG. 5A is a sketch illustrating the bootie used for attachment of a foot of a patient to the surface of the footboard member.
Figure 5:
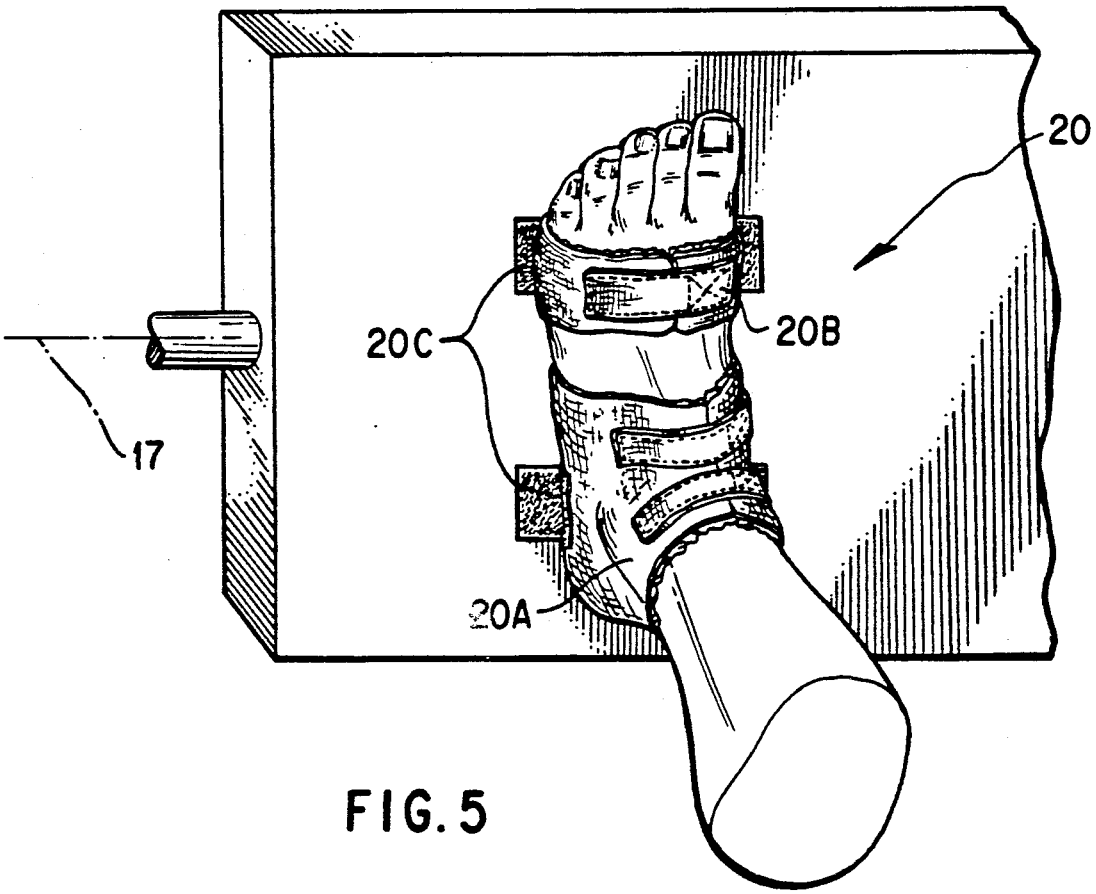
FIG. 5 is a sketch illustrating the attachment of a foot of a patient to the surface of the footboard member.
Figure 6:
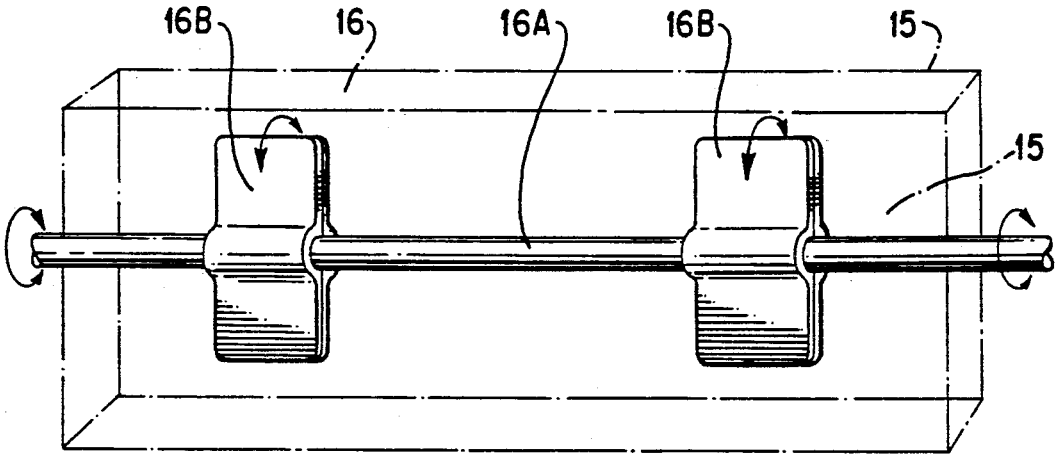
FIG. 6 is a sketch illustrating the means for transmitting the oscillatory motion of the shaft to the footboard member.

In the preferred embodiment the frame member 12 is illustrated as having a "U" shape in an up-side-down position. Attached to both of the legs of the frame 12 is a means 14 for attaching frame 12 to a mattress 6 which is resting on bed 5. The attaching means 14 comprises upper stabilizers 14A, lower stabilizers 14C and means to adjust 14B the spacing between the stabilizers 14A and 14C so that the frame 12 may be attachable to mattresses having a variety of thicknesses. The lower stabilizers 14C may be positioned between a box spring and mattress 6. Pivotably attached at the top of the frame 12 is at least one adjustable length attaching bar 14D (illustrated in FIGS. 4, 4A and 4B) which attaches the frame 12 to the footend frame component 8 of bed 5. The pivoting joints at the ends of bar 14D permit the assembly 10 to be positioned at various positions from the bottom of the bed 5 to accommodate the variation in the size of the patient who will be using the assembly 10.

Positioned between the legs of frame 12 is footboard member 16. Footboard 16 is attached to frame 12 so that it and surface 15 will be oscillatable about an axis 17 created by the footboard bar member 16A. The footboard 16 and surface 15 are caused to oscillate by oscillation means 18 which comprises application of a power source (for example, a small electric motor which drives bar 16A through a gear system converting rotation to oscillatory motion) to bar member 16A which is affixed to oscillatory flaps 16B. Flaps 16B may be inside or outside of member 16 so long as the oscillatory motion of the flaps 16B is translated ultimately to surface 15. Control means 22 provides the means for activating and deactivating means for oscillating 18 of footboard 16 and may have incorporated therein an oscillation amplitude control 22A, a timer control 22B and an oscillation frequency control 22C. Obviously the assembly 10 may have controls 22 which would range from a simple on-off switch to a completely programmable system which would control all of the details of the motion regimen for a patient having special needs.

Means 20 is provided for securely but releasably attaching the feet of a patient to assembly 10. Preferably booties 20A or straps 20B are attached to the feet of the patient. The booties 20A or straps 20B are then attached using fasteners 20C to surface 15 using, for example, VELCRO TM brand of fastener (the booties 20A and the straps 20B would have the complimentary portion of the VELCRO TM brand of fastener to that portion 20C which is positioned on surface 15) and attached in such a position so as to align the pivot of the ankle of the patient with axis of oscillation 17.

Figure 7:
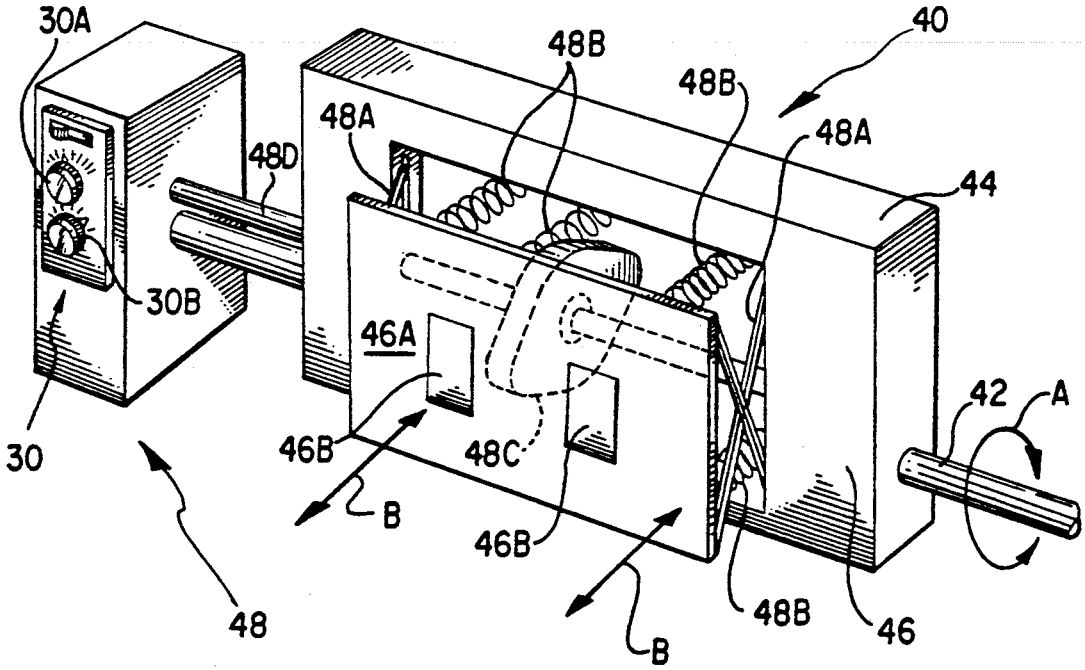
FIG. 7 is a sketch illustrating another embodiment of the oscillatable footboard assembly wherein the surface of the footboard member not only oscillates but also moves linearly to-and-fro driven by a cam shown partly in shadow and illustrating schematically the means for controllably driving the cam and which may also drive the oscillatory shaft.

Reference is now made to FIG. 7 which very simply and schematically illustrates a means for providing the to-and-fro motion, represented at B. The to-and-fro linear motion B of the footboard member 44 or the surface 46A is in a direction substantially parallel to the long side 3 of mattress 6 and substantially parallel to the upward-facing mattress surface 7. The linear distance traveled is not greater than the maximum linear distance of the foot of the patient when the foot is moved from a fully extended position to a position where the knee is fully flexed. A brace may be needed to keep the legs of a patient who is in a coma or otherwise unaware of what is happening, in proper alignment so that the legs do not randomly drop from side to side when the knee is being flexed. The means for providing the to-and-fro motion, represented at B is basically comprised of a power source 48 driving shaft 48D which in turn drives cam 48C. Shaft 48D may necessarily have universal joints to allow the combination of the oscillatory motion shown at A and the to-and-fro motion shown at B. Power source 48 may also incorporate the means for providing the oscillation shown at A to shaft 42. Surface 46A is maintained in alignment by the combination of hinging means 48A. Spring means 48B provides the force needed to cause surface 46A to return to the rest position or the position which causes the patients legs to be about fully extended. Cam 48C may vary in shape depending upon the extent of the linear motion desired. It is also possible either change cams as needed or to alter the cam geometry by having attachable lobes each having a different geometry. The motion depicted at B and the oscillatory motion depicted at A may take place concurrently and at controlled rates or for different but settable times. It is also understood that the means for providing motion B could involve the use of pneumatic cylinders which could be driven in two directions and the length of travel of the pistons of the cylinders could be controlled by a control means not illustrated. Means 30 activates and deactivates means 48 and may also have incorporated therein a settable linear motion timer 30A, a means for controlling a distance amplitude of the to-and-fro motion (not illustrated) and means 30B for controlling the rate of linear motion. The linear motion timer 30A thereby activates and deactivates the means 48 for linearly moving the footboard surface 46A at preset times. Booties 20A or straps 20B are used to secure the feet of the patient to pads 46B. If the surface 46A is divided into two portions each of which would be attachable to the right and the left foot of a patient, such two portions could be alternately driven in linear to-and-fro motion to substantially simulate the leg motion experienced when walking. This embodiment, while not illustrated herein is within the scope of the invention and the means for achieving such motion is well within the capability of an ordinarily skilled technician.

It is thought that the present invention, the method and the apparatus or assembly for regularly and controllably flexing and extending the feet and the legs of a patient who is unable to move their legs and/or feet due to some physical or mental disorder and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. In combination with a bed having at least a mattress and a foot-end frame component, an oscillatable footboard assembly comprising:

a frame member having means for attaching the frame member to at least one side of said mattress of said bed;

means for removably and nondamagingly attaching said frame member to said bed in a position appropriate for a patient positioned thereon wherein said means for removably and nondamagingly attaching said frame assembly to said bed further comprises at least one attaching bar, said bar further attaching said frame assembly to said foot-end frame component;

a footboard member rotatably and oscillatably attached to said frame member, said footboard member having at least a surface upon which feet of said patient positioned on said bed may be releasably attachable;

means for oscillating said footboard member about an axis substantially perpendicular to a long side of said bed and substantially parallel to a upward-facing mattress surface providing regular and oscillatory flexing and extending of both feet simultaneously and synchronously when said patient is releasably attached to said footboard member;

means for activating and deactivating said means for oscillating said footboard member; and means for securely but releasably attaching said feet of said patient to said footboard member in a position so that an ankle pivot of said patient is about in-line with said oscillation axis.

2. The oscillatable footboard assembly according to claim 1 further comprising a means for controlling an excursion amplitude of said oscillation and wherein said means for activating and deactivating further comprises a settable timer, said timer thereby activating and deactivating said means for oscillating at preset times.

3. The oscillatable footboard assembly according to claim 1 further comprising a means for controlling a frequency of said means for oscillating said footboard member.

4. The oscillatable footboard assembly according to claim 2 further comprising a means for controlling a frequency of said means for oscillating said footboard member.

5. The oscillatable footboard assembly according to claim 4 wherein said frame assembly is further adapted to be attachable to at least both sides of said bed.

6. The oscillatable footboard assembly according to claim 5 further comprising; means for providing, concurrent with said regular and oscillatory flexing and extending of both feet simultaneously and synchronously, to-and-fro linear motion of said footboard member in a direction substantially parallel to said long side of said bed and substantially parallel to said upward-facing mattress surface by a distance not greater than the maximum linear distance of said foot of said patient when said foot is moved from a fully extended position to a fully flexed position; and means for activating and deactivating said means for providing to-and-fro linear motion of said footboard member.

7. The oscillatable footboard assembly according to claim 6 wherein said means for activating and deactivating said means for linearly moving to-and-fro said footboard member further comprises a settable linear motion timer, said linear motion timer thereby activating and deactivating said means for linearly moving said footboard member at preset times; and further comprising a means for controlling a rate of linear motion of said footboard member.

* * * * *